US007608165B2

(12) United States Patent
Räisänen et al.

(10) Patent No.: US 7,608,165 B2
(45) Date of Patent: Oct. 27, 2009

(54) MULTI-LAYER WEB FORMATION SECTION

(75) Inventors: Kari Räisänen, Muurame (FI); Antti Poikolainen, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 464 days.

(21) Appl. No.: 10/597,940

(22) PCT Filed: Feb. 11, 2005

(86) PCT No.: PCT/FI2005/050027

§ 371 (c)(1),
(2), (4) Date: Aug. 28, 2006

(87) PCT Pub. No.: WO2005/078188

PCT Pub. Date: Aug. 25, 2005

(65) Prior Publication Data

US 2007/0158042 A1 Jul. 12, 2007

(30) Foreign Application Priority Data

Feb. 13, 2004 (FI) ..... 20040225

(51) Int. Cl.
*D21F 11/04* (2006.01)

(52) U.S. Cl. ..... 162/132; 162/133; 162/217

(58) Field of Classification Search ..... 162/123–133, 162/289, 298–304, 352, 358.3, 217
See application file for complete search history.

(56) References Cited

U.S. PATENT DOCUMENTS 3,625,814 A * 12/1971 De Noyer ..... 162/299
3,856,618 A * 12/1974 Roell ..... 162/299
3,891,501 A * 6/1975 Oka et al. ..... 162/290
3,985,612 A * 10/1976 Watanabe ..... 162/203
4,154,645 A * 5/1979 Kankaanpaa ..... 162/133
4,425,187 A * 1/1984 Armstrong et al. ..... 162/299
4,614,566 A * 9/1986 Koponen et al. ..... 162/301
4,830,709 A * 5/1989 Turner et al. ..... 162/133
4,917,766 A * 4/1990 Koivuranta et al. ..... 162/301
5,259,929 A * 11/1993 Bubik et al. ..... 162/301
5,468,348 A 11/1995 Blackledge et al.

(Continued)

FOREIGN PATENT DOCUMENTS

DE 2818118 * 11/1978

(Continued)

*Primary Examiner*—José A Fortuna
(74) *Attorney, Agent, or Firm*—Stiennon & Stiennon

(57) ABSTRACT

A multi-layer web formation section has at least two successive wire units (300, 310). First and second headboxes (100, 110) supply pulp suspension jets to the forward end of the first wire unit (300) and the second wire unit respectively to form a first partial web (W1) and a second partial web (W2) which are joined at a joint (N1) between the second wire unit (310) and a bottom wire (11). A first non-pulsating dewatering zone (Z1*b*) in the forward end of a two-wire stretch of the second wire unit (310) is formed by a fixed formation shoe (200*b*) having a curved cap (201) placed against one side, having openings with an under-pressure applied. A two-wire stretch of the second wire unit (310) has a second pulsating dewatering zone (Z2*b*), formed by fixed dewatering lists (210*b*) in the cross machine direction with gaps (220*b*) therebetween with an under-pressure (Pb) applied.

32 Claims, 6 Drawing Sheets

U.S. PATENT DOCUMENTS

| | | | | |
|---|---|---|---|---|
| 5,607,555 | A * | 3/1997 | Grossmann et al. | 162/301 |
| 5,914,009 | A * | 6/1999 | Kotitschke | 162/301 |
| 5,972,168 | A | 10/1999 | Egelhof et al. | |
| 6,342,125 | B1 * | 1/2002 | Nordstrom | 162/132 |
| 6,375,799 | B1 * | 4/2002 | Halmschlager et al. | 162/186 |
| 6,464,835 | B1 * | 10/2002 | Raisanen et al. | 162/203 |
| 6,616,811 | B2 * | 9/2003 | Wassermann et al. | 162/304 |
| 6,942,760 | B1 * | 9/2005 | Heikkila et al. | 162/306 |
| 7,300,553 | B2 * | 11/2007 | Poikolainen et al. | 162/301 |
| 7,364,643 | B2 * | 4/2008 | Poikolainen et al. | 162/203 |
| 2001/0025697 | A1 | 10/2001 | Wildfong et al. | |
| 2003/0000666 | A1 * | 1/2003 | Mansson et al. | 162/123 |
| 2005/0241792 | A1 * | 11/2005 | Poikolainen et al. | 162/301 |
| 2006/0162890 | A1 * | 7/2006 | Poikolainen et al. | 162/203 |
| 2007/0158042 | A1 * | 7/2007 | Raisanen et al. | 162/133 |
| 2007/0163736 | A1 * | 7/2007 | Raisanen et al. | 162/132 |
| 2007/0235153 | A1 * | 10/2007 | Poikolainen et al. | 162/352 |
| 2008/0115902 | A1 * | 5/2008 | Poikolainen et al. | 162/301 |

FOREIGN PATENT DOCUMENTS

| | | | |
|---|---|---|---|
| EP | 0289445 | A2 | 11/1988 |
| GB | 2041030 | A * | 9/1980 |
| WO | WO 02/070817 | A1 * | 9/2002 |
| WO | WO 2004018768 | A1 * | 3/2004 |
| WO | WO 2005078187 | A1 * | 8/2005 |
| WO | WO 2005078188 | A1 * | 8/2005 |
| WO | WO 2007096467 | A1 * | 8/2007 |
| WO | WO 2008000900 | A1 * | 1/2008 |

* cited by examiner

MULTI-LAYER WEB FORMATION SECTION

CROSS REFERENCES TO RELATED APPLICATIONS

This application is a U.S. national stage application of international app. No. PCT/FI2005/050027, filed Feb. 11, 2005, the disclosure of which is incorporated by reference herein, and claims priority on Finnish App. No. 20040225, filed Feb. 13, 2004.

STATEMENT AS TO RIGHTS TO INVENTIONS MADE UNDER FEDERALLY SPONSORED RESEARCH AND DEVELOPMENT

Not applicable.

BACKGROUND OF THE INVENTION

In the formation section according to the invention, a multi-layer web is made in at least two successive wire units. The first partial web is formed in a first wire unit, which may be a single-wire or a two-wire unit. A second partial web is formed in a second wire unit, which is a two-wire unit. After the first wire unit the first partial web is guided on a bottom wire into a joint, which is located in the area of the second wire unit in between the second wire unit and the bottom wire and wherein the first partial web is joined to the second partial web. The second wire unit may be followed by a third wire unit, a fourth wire unit etc. The partial web of each wire unit is always joined atop the preceding partial webs at the joint between the concerned wire unit and the bottom wire.

When a web is made of aqueous wood-fiber stock, water is removed from the pulp on the formation section through the formation wire or formation wires in order to start the web formation. The wood pulp fibers remain randomly distributed on the formation wire or in between the formation wires, which are travelling together.

Fiber pulps of different types are used depending on the quality of web to be made. The water quantity, which can be removed from different fiber pulps in order to achieve a web of good quality, is a function of many factors, such as, for example, a function of the desired basis weight of the web, the designed velocity of the machine, and the desired level of fines, fibers and fillers in the final product.

Equipment of several types are known in the web formation section, that is, in the former, such as foil lists, suction boxes, hitch rolls, suction rolls and rolls provided with an open surface, which have been used in several different formations and orders in an attempt to optimize the quantity of removed water, the time and location in the formation of the web. Making a web is still an art in part and science in part in that simply removing water as quickly as possible will not produce a final product of optimum quality. In other words, making a final product of a high quality especially at high velocities is a function of the dewatering quantity, the dewatering method, the time of dewatering and the location of dewatering.

When it is desirable to maintain or improve the quality of the final product when proceeding to higher production speeds, unforeseeable problems often occur, in consequence of which either the production quantity must be reduced to maintain the desired quality or the desired quantity must be given up in order to achieve a higher production quantity.

It is known in the state of the art to use formation shoes to guide one or two formation wires on the formation section. It is also known to use a so-called formation roll provided with an open surface, for example, a perforated one, to receive water into the formation roll from the fiber pulp lying on the formation wire.

The state-of-the-art list elements or foils of formation shoes or list shoes, which have a curved surface or which are planar, are arranged in the cross machine direction at right angles to the travelling direction of the formation wire. In between the list elements there are gaps defining leading edges for the list elements. A stock jet is directed against the formation wire over the leading edge of the formation shoe/list in such a way that part of the water contained in the stock jet will travel through the formation wire to end up below the shoe/list. Each foil, list element or formation shoe is either open at its bottom to the pressure of the air outside or they are connected to a vacuum source in order to improve the dewatering process by forcing water into the gaps in between the foils or list elements. The list elements constitute the cap of the foil or formation shoe.

When increasing machine velocities, new phenomena will occur in the web formation and they will affect the machine runnability and the looks of the produced final product as well as its internal structure. An undesirable distribution of fines and fillers may occur in the surface or internal parts of the final product, whereby retention will suffer.

Two-wire formers used in board-making machines and in papermaking machines can be divided into two main types, which are the roll jaw former and the list jaw former.

The roll jaw former, wherein the pulp jet of the headbox hits a roll having a relatively large radius, is insensitive to minor geometric errors, to errors in the jet quality and to external effects, such as air resistance and water drops. As regards characteristics in the Z direction, such as the distribution of fillers and anisotropy of fibers, an excellent two-sidedness is achieved. This is so because the fiber mat is at first formed at the same time on both wires at a constant dewatering pressure (that is, non-pulsatingly). A good retention is also achieved thanks to the constant dewatering pressure in the initial part of the dewatering zone.

A drawback of the roll jaw former is that the rotation of the formation roll brings about an under-pressure pulse on the discharge side of the roll nip. This under-pressure pulse partly damages (crushes) the structure of the formed web as it is travelling from the formation roll's dewatering zone where a constant pressure exists to the following dewatering zone where a pulsating pressure exists, if the web is too wet at this point. Hereby the damaged web can no longer withstand powerful pulsating, whereby the dewatering must be limited in the pulsating dewatering zone. The price of the formation roll and its spare parts as well as the need for roll service and the resulting time of machine standstill also constitute a disadvantage. In addition, it has been found to be a problem with the roll jaw former that the dewatering capacity is not sufficient at high velocities and with dense pulps. In addition, the big rotating roll forms a source of vibrations in the formation section. In practice, the radius of the formation roll cannot be very long, whereby the wires travelling over it are subjected to a great force directed towards the shell. For this reason, the outer wire tends to attach at its edges to the inner wire, whereby the pulp located in between the wires is subjected, especially when the headbox jet is very thick, to a flow motion directed towards the center, in consequence of which the orientation of fibers becomes less advantageous. The big formation roll also takes much space and, in addition, a standby roll is also needed at all times.

In a list jaw former, the pulp jet of the headbox hits a shoe having a relatively long radius and where pulsating dewatering is pursued. Due to the pulsating dewatering right at the beginning of the formation section, the former has a good formation potential. Since all dewatering components are fixed, acquisition and service costs are lower than when using a roll as the first dewatering device.

However, the list jaw former is sensitive to many errors, such as changes occurring in the pulp jet, and this circumstance restricts the former's efficient operation. The dewatering is quite asymmetric to begin with, which in the Z direction results in unequal sidedness in the web structure, especially as regards the distribution of fillers and the anisotropy of fiber orientation. Since the dewatering of pulp is done under a pulsating pressure to begin with, retention is low.

The roll jaw former and the list jaw former may also be combined to form a roll-list jaw former. A non-pulsating dewatering zone together with a pulsating dewatering zone are used as a combination in the roll-list jaw former. The former's first non-pulsating dewatering zone comprises a formation roll (a suction roll provided with an open surface), after which a pulsating dewatering zone is arranged, wherein a loading element-suction box combination is located. With such an arrangement a good retention and a symmetric paper have been achieved, but poorer formation results than with the traditional list jaw formers. This is due to the fact that the rotational motion of the formation roll brings about an under-pressure peak in the web after the formation roll, which will damage the web already formed.

The big rotating roll of the roll-list jaw former forms a vibration source in the formation section. In practice, the radius of the formation roll cannot be very long, whereby the wires travelling over it are subjected to a strong force directed towards the shell. For this reason, the outer wire tends to attach at its edges to the inner wire, whereby the pulp located in between the wires is subjected, especially with very thick headbox jets, to a flow motion directed towards the center, in consequence of which the fiber orientation becomes less advantageous. A big formation roll also takes much space and, in addition, a standby roll is also required at all times.

U.S. Pat. No. 5,468,348 presents a multi-layer web formation section. The formation section comprises a bottom wire transporting the web's base layer and a two-wire formation section forming the web's top layer. The top layer formation section comprises a first wire loop and a second wire loop, which form a curved two-wire zone. At the beginning of the two-wire zone the formation wires form a jaw, into which a headbox supplies a pulp suspension jet. Inside the first wire loop in the two-wire zone a foil box is arranged, wherein there are several dewatering foils. In addition, an under-pressure may be connected to the foil box. Inside the second wire loop in the two-wire zone only water collecting equipment is arranged, which is used to collect the water discharging from the pulp through the second wire. The tension of the second wire causes a pressure on the curved foil box in the pulp located between the wires, whereby water is removed from the pulp to the outside also through the second wire. A centrifugal force also removes water to the outside through the second wire. By this arrangement most of the water in the pulp is removed through the first wire into the foil box. Only little water discharges through the web surface located against the second wire, and this dewatering is not boosted by under-pressure, whereby fines will remain in the concerned web surface. After the two-wire zone, the formed web is released from the second wire and attached to the first wire, whereupon the travelling direction of the first wire is reversed by a hitch-suction roll. The bottom wire forms a joint with said hitch-suction roll in such a way that the web base layer travelling on the bottom wire and the web top layer travelling on the hitch-suction roll on the first wire of the two-wire stretch are joined together at said joint. The combined web formed by the base layer and the top layer is released from the first wire and attached to the bottom wire at a transfer-suction box located after said joint.

U.S. Pat. No. 4,830,709 presents a multi-layer web formation section, wherein a top layer is formed atop a base layer. The formation section comprises a bottom wire transporting the web's base layer and a two-wire formation section forming the web's top layer. The top layer formation section comprises a first wire loop and a second wire loop, which form a two-wire zone. At the beginning of the two-wire zone the formation wires form a jaw, into which a headbox supplies a pulp suspension jet. Inside the first wire loop in the two-wire zone a formation shoe is arranged, wherein there may be several foils in the cross machine direction or several gaps or perforations. In addition, an under-pressure may be connected to the formation shoe. Inside the first wire loop in the two-wire zone a dewatering shoe provided with foils and a pressure foil with a smooth surface are also arranged. Inside the second wire loop a dewatering shoe with a curved surface is also arranged. After the two-wire zone the formed web is released from the second wire and attached to the first wire, whereupon the travelling direction of the first wire is reversed by a hitch roll. The bottom wire forms a joint with said hitch roll in such a way that the web's base layer travelling on the bottom wire and the web's top layer travelling on the hitch roll on the first wire of the two-wire stretch are joined together at said joint. The combined web formed by the base layer and the top layer is released from the first wire and attached to the bottom wire at a transfer-suction box located after said joint.

SUMMARY OF THE INVENTION

The solution according to the invention constitutes an improvement on the state-of-the-art solutions.

In the formation section according to the invention there are at least two successive wire units. The first wire unit is either a single-wire or a two-wire unit, to which a stock jet is supplied by a first headbox in order to form a first partial web. The second wire unit is a two-wire unit, to which a pulp suspension jet is supplied by a second headbox in order to form a second partial web. The first partial web formed in the first wire unit is guided on the bottom wire to a joint between the second wire unit and the bottom wire. At this joint, the second partial web is joined to the first partial web. The dewatering of the two-wire stretch of the second wire unit is both structurally and process-technically a combination of two elements in such a way that all the advantages of a list-jaw former and a roll-jaw former can be achieved without their associated drawbacks.

The first element is a fixed formation shoe having a curved cap and provided with openings extending through the cap, in which formation shoe it is possible to use under-pressure to control and boost the dewatering. The formation shoe is constructed in such a way that dewatering may take place freely at the same time through both formation wires travelling over the curved cap of the formation shoe. The cap of the formation shoe provides an essentially constant dewatering pressure according to the equation $P=T/R$, wherein $P$=pressure of the liquid in between the formation wires travelling over the formation shoe, $T$=tension of the outermost web, and $R$=radius of curvature of the fixed formation shoe. The intention is that the formation shoe will not cause any pulsating dewatering even when the dewatering is boosted by under-pressure. The formation shoe can be thought of as being the curve of a "fixed roll" provided with an open surface. The cap has a large open surface area and through openings it is connected to an under-pressure chamber located inside the formation shoe. The openings in the cap of the formation shoe are formed in such a way that pulsating dewatering is avoided, which would result if the openings were formed by longitudinal gaps in the cross machine direction. In order to bring about this essentially constant pressure, these openings are either holes, gaps arranged essentially in the machine direction, wave-like gaps, upstanding contact surfaces in the machine direction to carry the web above the shoe cap, etc. The cross-section of the holes may be round, square, elliptic or polygonal.

The second dewatering element is a pulsating dewatering element comprising fixed dewatering lists mounted on the other side of the formation wires in the cross machine direction and provided with gaps. In connection with the fixed lists it is possible to use under-pressure, which through the gaps in between the lists affects the pulp located in between the formation wires. In addition, in the gaps between the fixed dewatering lists it is possible to locate adjustable dewatering lists on the side opposite to the formation wires in relation to the fixed dewatering lists. These adjustable dewatering lists are used to boost further the pulsating impact on the web.

Dewatering first takes place in the non-pulsating dewatering zone essentially under a constant pressure as two-sided dewatering, owing to which the web structure is symmetric in the Z direction.

No under-pressure peak occurs on the output side of the non-pulsating dewatering zone, because the structure is fixed. In this way that tendency damaging the web is avoided, which relates to the non-pulsating dewatering zone formed by a roll.

In the non-pulsating dewatering zone water can be removed even from a very wet web without breaking the structure of the web. In consequence of this, the web may be brought very wet to the formation shoe, where water is removed from the web through the openings of the non-pulsating formation shoe under the effect of under-pressure existing in the openings. A very effective dewatering is provided in this manner. After the non-pulsating dewatering zone the web is guided into the pulsating dewatering zone with such a dry-matter content that formation of the web can be improved by pulsating dewatering. The higher dewatering capacity also allows a higher production rate.

The capital and maintenance costs of a non-pulsating fixed formation shoe are lower than those of a roll and standby roll.

According to each purpose of use, the radius of the non-pulsating fixed formation shoe and the shoe length in the machine direction can be changed within a larger range than would be practical when using a roll. The fixed formation shoe may also be formed by several curves, for example, in such a way that the radius of the formation shoe is longer at the input end, but it becomes progressively shorter as a spiral-like arch towards the output end. In such a case the dewatering pressure is no longer constant over the formation shoe, but it remains non-pulsating nevertheless. The possibility of changing the radius in both the manners told above as well as the shoe length means that non-pulsating dewatering can always be designed to be suitable according to each application in a considerably easier way than is possible to do in connection with a roll.

The combination of a non-pulsating dewatering zone and a pulsating dewatering zone allows easier control of the dewatering between the non-pulsating and the pulsating dewatering zones, whereby the dewatering can be controlled more easily and better than in the known formers. In consequence of this, the balance between formation and retention can be better controlled and the strength properties of the web can be optimized. By adjusting the under-pressure level of the non-pulsating formation shoe it is possible to adjust the distribution of dewatering between the top and bottom surfaces of the web, which for its part affects the distribution of fines between the top and bottom surfaces. Hereby the fines content can be controlled in that surface of the pulp, which is combined with the partial web formed in the preceding wire unit. There must be sufficiently fines in the joining surfaces of the partial webs, so that a strong bond is formed between the partial webs.

The high dewatering capacity of the non-pulsating formation shoe at the beginning of the two-wire stretch makes it possible for the lip jet of the headbox to be very thick. The formation section can hereby be used within a large basis weight range. In addition, it is possible in the fixed formation shoe to use a long radius of curvature, whereby the tension of the outer wire travelling on the shoe causes less dewatering pressure on the pulp located in between the wires. This again reduces the flow tendency in the cross direction, which acts on the pulp travelling in between the wires, whereby fiber orientation errors are avoided in the pulp layers located in the edge areas of the wires.

In the following the invention will be described by referring to the figures shown in the appended drawings.

DESCRIPTION OF THE PREFERRED EMBODIMENTS

Figure 1:
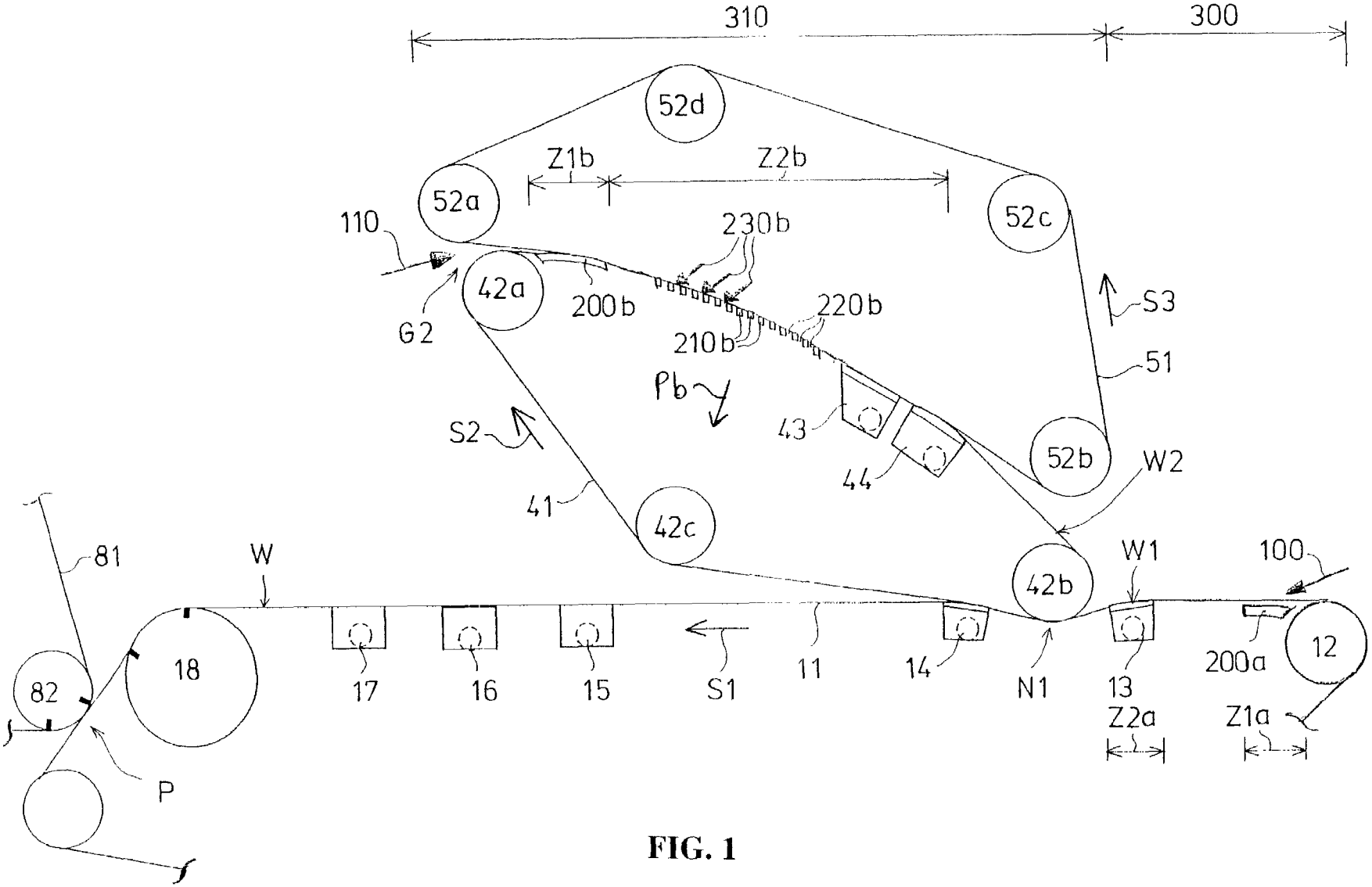
FIG. 1 is a schematic side view of a formation section according to the invention provided with two wire units.

FIG. 1 shows a formation section according to the invention provided with two successive wire units 300, 310. The first wire unit 300 is a single-wire unit and the second wire unit 310 is a two-wire unit.

The first wire unit 300 is formed by a bottom wire loop 11 and by dewatering equipment 200*a*, 13 arranged under the bottom wire 11. A first headbox 100 supplies a pulp suspension jet on to the bottom wire 11 to the forward end of the bottom wire, immediately after a breast roll 12 in order to form a first partial web W1. The travelling direction of the bottom wire 11 is indicated by an arrow S1, so this direction is also the machine direction.

After the first wire unit 300 there is a second wire unit 310. The second wire unit 310 comprises a first wire 41 made to form an endless wire loop with the aid of hitch rolls and guide rolls 42*a*, 42*b*, 42*c* and a second wire 51 made to form an endless wire loop with the aid of hitch rolls and guide rolls 52*a*, 52*b*, 52*c*, 52*d*. The first wire 41 and the second wire 51 have a stretch in common, wherein they form a two-wire stretch of the second wire unit 310. The first hitch and guide roll 42*a* of the first wire 41 and the first hitch and guide roll 52*a* of the second wire 51 are located in such a way that a wedge-like jaw G2 defined by the first wire 41 and the second wire 51 is formed at the beginning of the two-wire stretch. A second headbox 110 supplies a pulp suspension jet into this jaw G2. The travelling direction of the first wire 41 is indicated by an arrow S2 and the travelling direction of the second wire 51 is indicated by an arrow S3.

At the output end of the two-wire stretch of the second wire unit 310 the second wire 51 is separated from the first wire 41 at an internal first transfer-suction box 44 of the first wire link 41. The second partial web W2 formed on the two-wire stretch is released at the same time from the second wire 51 and attached to the first wire 41. Then the travelling direction of the first wire 41 and of the second partial web W2 travelling on top of it is reversed by a hitch roll 42*b*. The hitch roll 42*b* forms a joint N1 with the bottom wire 11. At this joint N1, the second partial web W2 is combined with the first partial web W1. The surface of the first partial web W1, which is opposite to the bottom wire 11, forms the joint surface of the first partial web W1. The surface of the second partial web W2, which was against the second wire 51, forms the joint surface of the second partial web W2. After joint N1, the combined web W is released from the first wire 41 and attached to bottom wire 11 by a second transfer-suction box 14 located inside the bottom wire loop 11, whereupon the combined web W is transferred over the internal suction boxes 15, 16, 17 of the bottom wire link 11. Then the direction of travel of the bottom wire 11 is reversed by the suction sector of hitch-suction roll 18, whereupon the combined web W is transferred at pick-up point P aided by the under-pressure of the suction sector of pick-up suction roll 82 to pick-up fabric 81, whereupon the web W is transferred on the pick-up fabric 81 for further treatment. Before joint N1, a suction box 13 is mounted inside the bottom wire loop 11 to make sure that the first partial web W1 will attach to the bottom wire 11.

Two successive dewatering zones Z1*b*, Z2*b* are mounted in the two-wire stretch of the second wire unit 310. In the first dewatering zone Z1*b* non-pulsating dewatering is brought about in the pulp located between the wires 41, 51, and in the second dewatering zone Z2*b* pulsating dewatering is brought about in the pulp located between the wires 41, 51.

The first dewatering zone Z1*b* is formed inside the first wire loop 41 by a fixed first formation shoe 200*b* mounted right at the beginning of the two-wire stretch and provided with a curved cap. Openings extend through the cap of the first formation shoe 200*b*, through which openings an under-pressure is conducted to the pulp suspension located in between the first wire 41 and the second wire 51 in order to remove water from the pulp suspension. By using the first formation shoe 200*b*, non-pulsating dewatering is brought about in the pulp. The first formation shoe 200*b* is further arranged in such a way that the pulp suspension jet supplied from the second headbox 110 into the second jaw G2 will not hit the leading edge of the first formation shoe 200*b*, but it will be guided after the leading edge into the area of the cap of the first formation shoe 200*b*. Thus, the leading edge of the first formation shoe 200*b* will not remove water from the fiber pulp.

The second dewatering zone Z2*b* is formed by fixed dewatering lists 210*b* and dewatering lists 230*b*, which can be loaded in a controlled manner. After the first formation shoe 200*b*, fixed dewatering lists 210*b* are mounted inside the first wire link 41 in the cross machine direction, and these lists are placed against the inner surface of the first wire 41, thus forming a curved dewatering zone. Between these fixed dewatering lists 210*b* there are gaps 220*b*, through which under-pressure Pb is conducted to the already partly formed second partial web W2 located in between the first wire 41 and the second wire 51 in order to remove water from it. Inside the second wire loop 51 again there are controllable dewatering lists 230*b*, which are loaded against the inner surface of the second wire 51 and which are located at the gaps 220*b* between the above-mentioned fixed dewatering lists 210*b*. By this solution pulsating dewatering is brought about in the area of the fixed dewatering lists 210*b* and the dewatering lists 230*b*, which are loaded in a controllable manner. After the fixed dewatering lists 210*b*, a suction box 43 and the above-mentioned first transfer-suction box 44 are mounted inside the first wire link 41.

On the first wire unit 300 there are also two dewatering zones Z1*a*, Z2*a*. The first dewatering zone Z1*a* is formed by a fixed second formation shoe 200*a* arranged under the fourdrinier wire 11 at the place of impact of the pulp suspension jet supplied by the first headbox 100. The second formation shoe 200*a* has a structure similar to that of the first formation shoe 200*b* located at the beginning of the two-wire stretch of the second wire unit 310. The pulp suspension jet of the first headbox 100 hits the second formation shoe 200*a* preferably at an angle of 2-6 degrees immediately in the area after the leading edge of the second formation shoe 200*a*. Thus, the leading edge of the second formation shoe 200*a* removes no water from the fiber pulp. The second formation shoe 200*a* brings about non-pulsating dewatering in the fiber pulp travelling on the fourdrinier wire 11. The second dewatering zone Z2*a* is formed by a suction box 13 arranged under the fourdrinier wire 11 just before the joint N1 of the partial webs W1, W2. In the suction box 13 there is a list cap placed against the inner surface of the fourdrinier wire 11 and under-pressure acting through the openings in the list cap, whereby the fiber pulp travelling on the fourdrinier wire 11 is subjected to pulsating dewatering in the area of the suction box 13.

Figure 2:
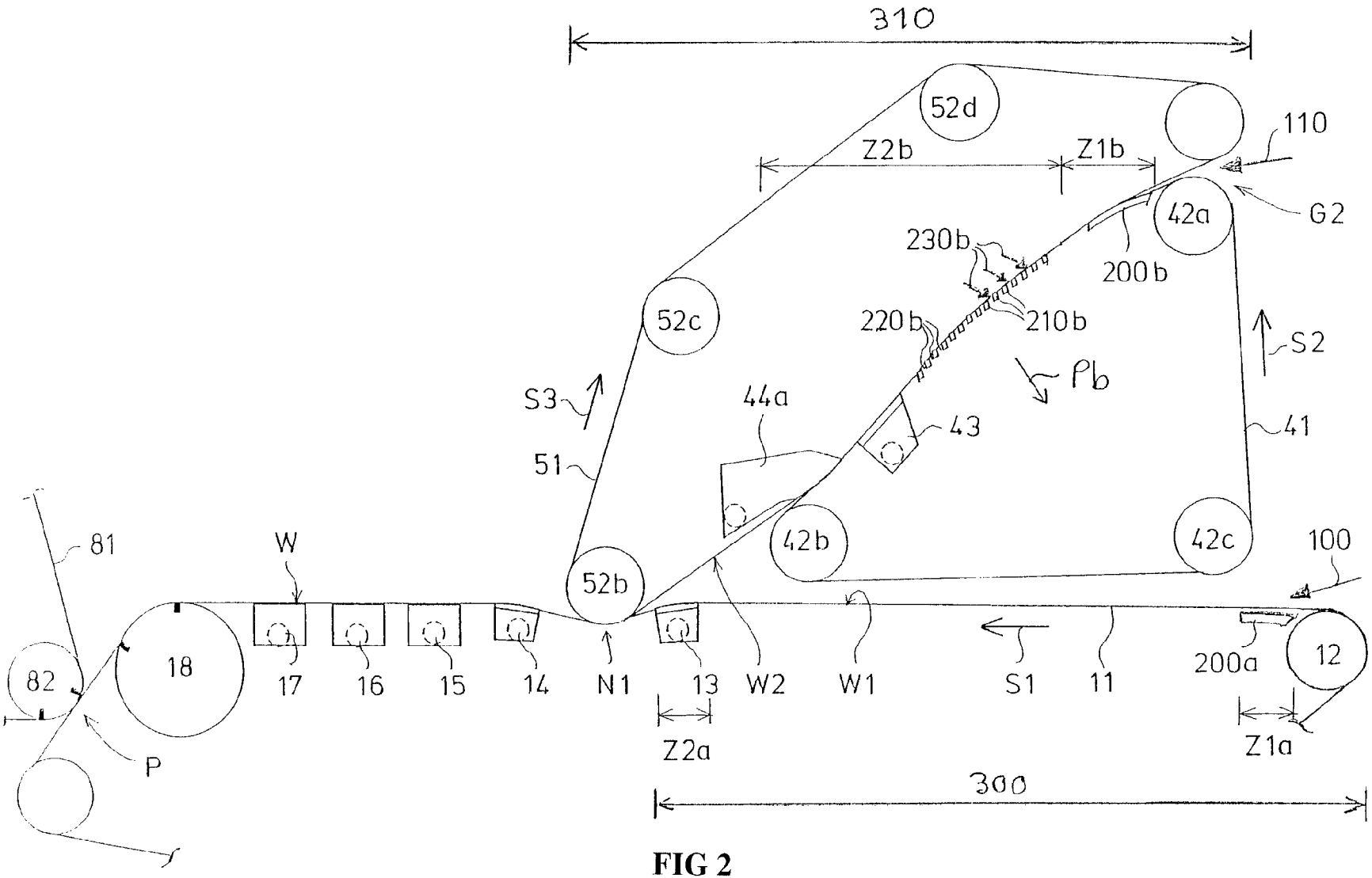
FIG. 2 is a schematic side view of another formation section according to the invention provided with two wire units.

FIG. 2 shows a modification of the formation section shown in FIG. 1. The difference is found in the direction in which the pulp of the second wire unit 310 is supplied and in the output end of the two-wire stretch, where a first transfer-suction box 44*a* is located inside the second wire link 51. The second wire 51 is released from the first wire 41 at said transfer-suction box 44*a*. The second partial web W2 formed on the two-wire stretch is released at the same time from the first wire 41 and made to attach to the second wire 51. Then the travelling direction of the second wire 51 and of the second partial web W2 travelling on top of it is changed by a hitch roll 52*b*. The hitch roll 52*b* forms a joint N1 together with the bottom wire 11. At this joint N1, the second partial web W2 is joined to the first partial web W1. The surface, which is opposite to the first partial web W1 in relation to bottom wire 11, forms the joint surface of the first partial web W1. The surface of the second partial web W2, which was against the first wire 41, forms the joint surface of the second partial web W2. After joint N1, the situation corresponds to the situation of FIG. 1. The first wire unit 300 is similar to the first wire unit 300 shown in FIG. 1.

Figure 3:
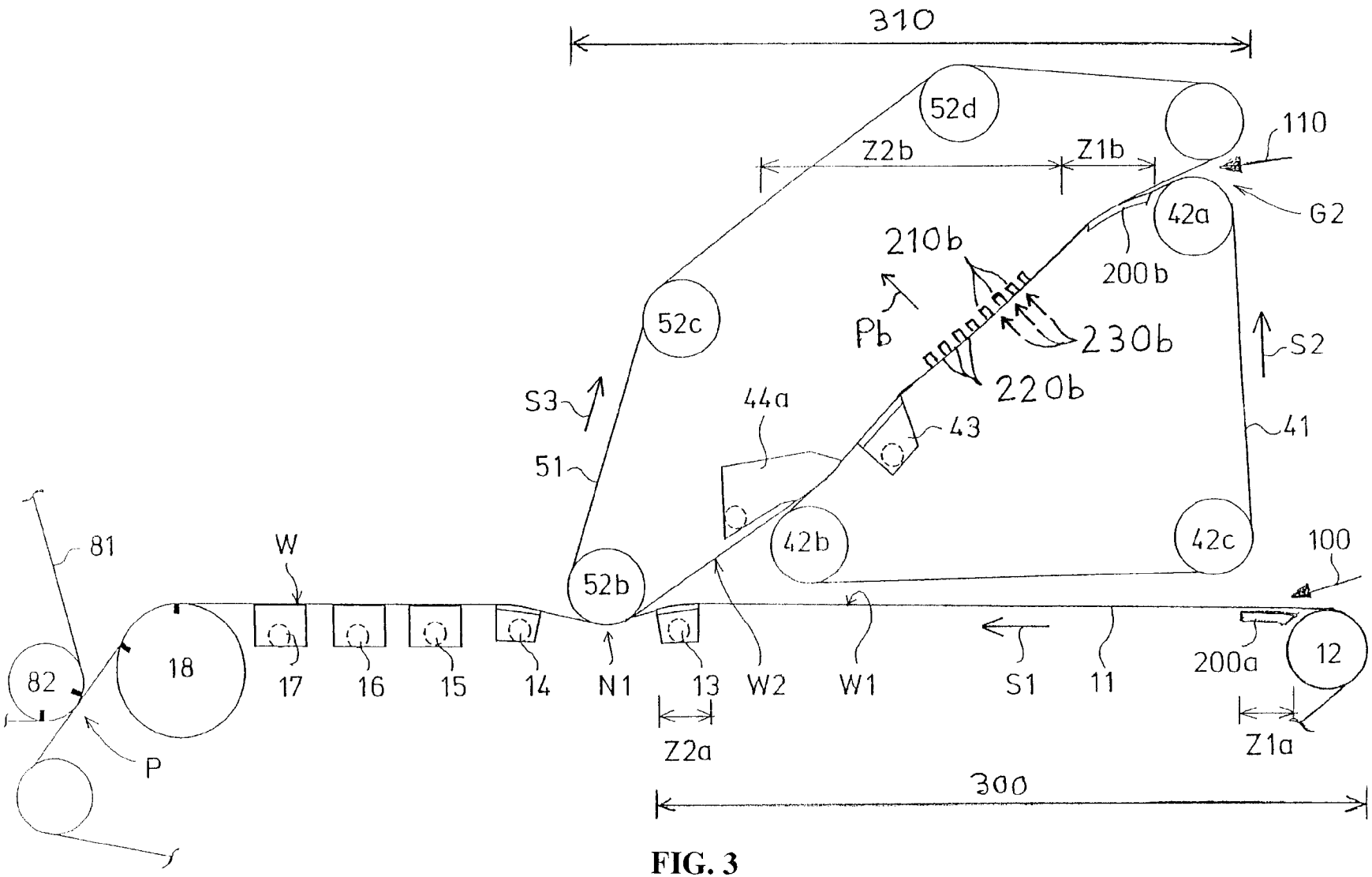
FIG. 3 is a schematic side view of a third formation section according to the invention provided with two wire units.

FIG. 3 shows a modification of the formation section shown in FIG. 2. The difference is found in the second dewatering zone Z2*b* of the second wire unit 310, wherein pulsating dewatering is brought about in the pulp travelling in between the wires 41, 51. In this embodiment, the fixed dewatering lists 210*b* are inside the second wire link 51 and the dewatering lists 230*b*, which can be loaded in a controlled manner, are inside the first wire link 41. Besides, the direction of the under-pressure Pb conducted into the gaps 220*b* of the fixed dewatering lists 210*b* is the opposite direction to the one shown in FIG. 2. In others respects the embodiment shown in FIG. 3 is similar to the one shown in FIG. 2.

Figure 4:
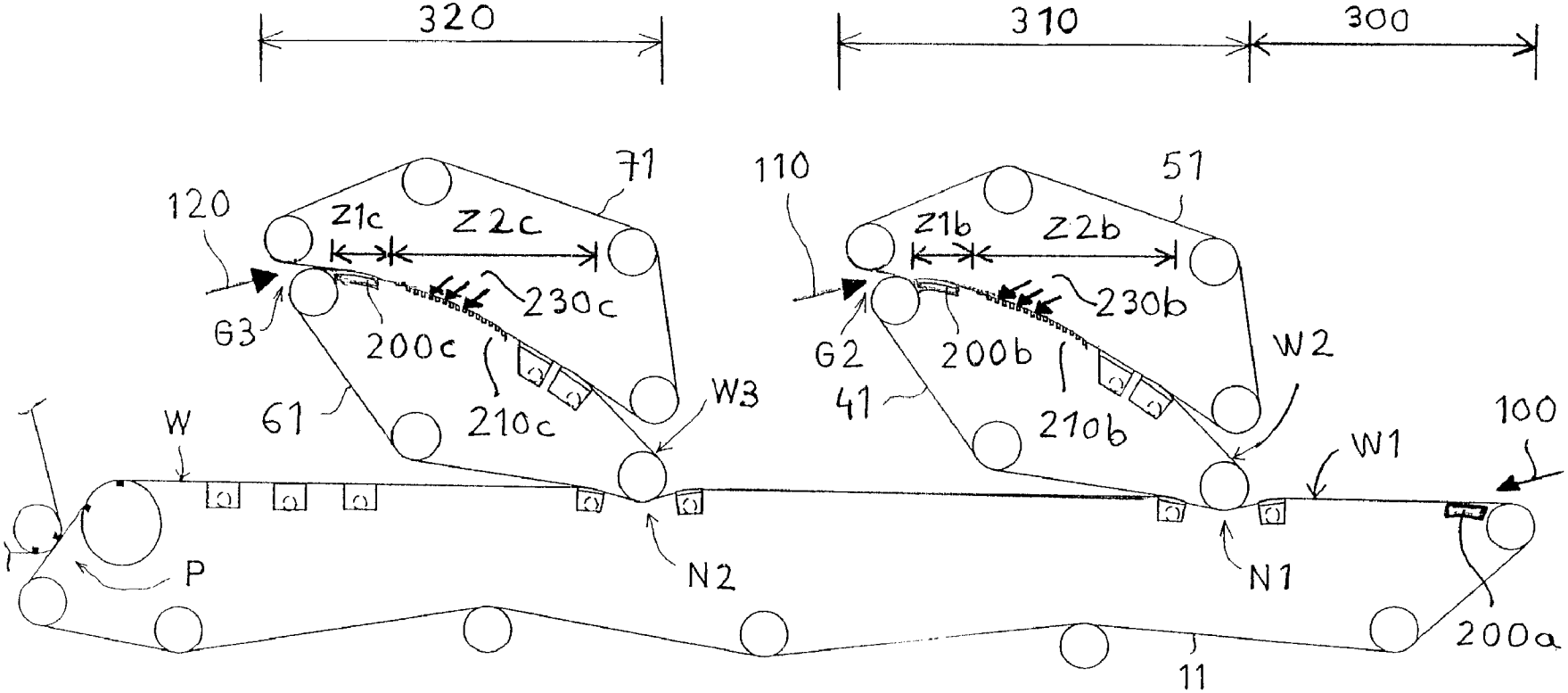
FIG. 4 is a schematic side view of a fourth formation section according to the invention provided with three wire units.

FIG. 4 shows a formation section formed by three wire units 300, 310, 320. The first wire unit 300 is a fourdrinier wire unit and it is similar to the fourdrinier wire unit 300 shown in FIG. 1. The second 310 and third 320 wire units are identical and they are entirely similar to the second wire unit 310 shown in FIG. 1. A first headbox 100 supplies a pulp suspension jet to the forward end of the first wire unit 300 on to the fourdrinier wire 11. A second headbox 110 supplies a pulp suspension jet to the forward end of the second wire unit 310 into a jaw G2 formed in between the formation wires 41, 51, and a third headbox 120 supplies a pulp suspension jet to the forward end of the third wire unit 320 into a jaw G3 formed in between the formation wires 61, 71. The first partial web W1 is formed in the first wire unit 300, the second partial web W2 is formed in the second wire unit 310 and the third partial web W3 is formed in the third wire unit 320. The first partial web W1 is transferred on the bottom wire 11 to a first joint N1 in between the second wire unit 310 and the bottom wire 11, at which joint the second partial web W2 is joined atop the first partial web W1. Then the web formed by the first partial web W1 and by the second partial web W2 is transferred on the bottom wire 11 to a second joint N2 in between the third wire unit 320 and the bottom wire 11, at which joint the third partial web W3 is joined atop the web formed by the first partial web W1 and the second partial web W2. Then the combined web W is transferred to a pick-up point P in accordance with FIG. 1.

In FIG. 4, the final web W is formed by three partial webs W1, W2, W3, that is, by a first partial web W1 formed in the first wire unit 300, by a second partial web W2 formed in the second wire unit 310 and by a third partial web W3 formed in the third wire unit.

The dewatering arrangements of the second and third wire units 310, 320 are exactly alike. The dewatering arrangement is formed in each wire unit 310, 320 by two successive dewatering zones Z1*b*, Z2*b*, Z1*c*, Z2*c*. The dewatering zones Z1*b*, Z2*b*, Z1*c*, Z2*c* of each wire unit 310, 320 are entirely similar to the dewatering zone Z1*b*, Z2*b* of the second wire unit 310 shown in FIG. 1. The first dewatering zone Z1*b*, Z1*b* is formed by a non-pulsating formation shoe 200*b*, 200*c*, which is followed by a second pulsating dewatering zone Z2*b*, Z2*c* formed by fixed dewatering lists 210*b*, 210*c* and dewatering lists 230*b*, 230*c*, which can be loaded in a controlled manner.

Figure 5:
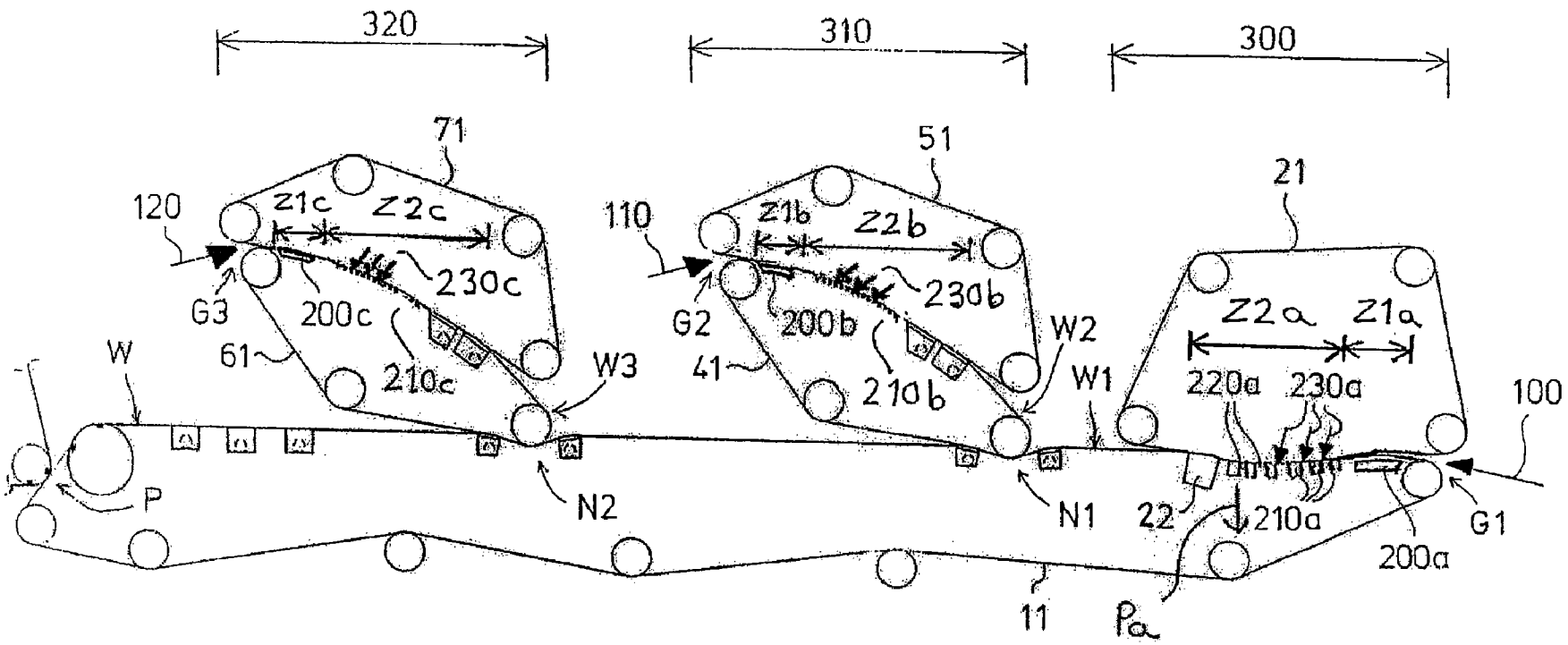
FIG. 5 is a schematic side view of a fifth formation section according to the invention provided with three wire units.

FIG. 5 shows a formation section formed by three wire units 300, 310, 320. The difference from the embodiment shown in FIG. 4 is found in the first wire unit 300. In this embodiment, the first wire unit 300 is a two-wire unit. The first wire unit 300 is formed by a bottom wire 11 and by a top wire loop 21 mounted above it, which together form the two-wire stretch of the first wire unit 300. A first headbox 100 supplies a pulp suspension jet into a first jaw G1 formed by the bottom wire 11 and the top wire 21.

In the first wire unit 300 there are two dewatering zones Z1*a*, Z2*a*. The first dewatering zone Z1*a* is formed by a second formation shoe 200*a* mounted inside the bottom wire loop 11 at the beginning of the two-wire zone. In the area of the first dewatering zone Z1*a*, non-pulsating dewatering is brought about in the pulp travelling in between the wires 11, 21. The second dewatering zone Z2*a* is formed by fixed dewatering lists and dewatering lists, which can be loaded in a controlled manner, 210*a*, 230*a* in the cross machine direction. The fixed dewatering lists 210*a* are mounted inside the bottom wire loop 11 and in between them there are gaps 220*a*, from which under-pressure Pa is directed to the web located between the wires 11, 21. The dewatering lists 230*a*, which can be loaded in a controlled manner, are mounted inside the top wire loop 21 at the gaps 220*a* of the fixed dewatering lists 210*a*. In the area of the second dewatering zone pulsating dewatering is brought about in the pulp travelling between the wires 11, 21. After this follows a transfer-suction box 22, which is mounted inside the bottom wire loop 11 and at which the top wire 21 is separated from the bottom wire 11. The first partial web W1 formed at the transfer-suction box 22 is released from the top wire 21 and made to attach to the bottom wire 11.

Then follows the situation shown in FIG. 4, where we have two successive wire units 310, 320. In the second wire unit 310 a second headbox 110 supplies a pulp suspension jet into a second jaw G2 formed at the beginning of the second wire unit 310 in between the formation wires 41, 51, whereupon a second partial web W2 is formed in the second wire unit 310. The second partial web W2 formed in the second wire unit 310 is joined to the first partial web W1 at a first joint N1 between the bottom wire 11 and the second wire unit 310. In the third wire unit 320 a third headbox 120 supplies a pulp suspension jet into a third jaw G3 formed at the beginning of the third wire unit 320 in between the formation wires 61, 71, whereupon a third partial web W3 is formed in the third wire unit 320. The third partial web W3 is joined to the web formed by the first partial web W1 and the second partial web W2 at a second joint N2 between the bottom wire 11 and the third wire unit 320.

In FIG. 5, the final web W is formed by three partial webs W1, W2, W3, that is, by the first partial web W1 formed in the first wire unit 300, the second partial web W2 formed in the second wire unit 310 and the third partial web W3 formed in the third wire unit 320.

The dewatering arrangements of the second and third wire units 310, 320 are entirely alike. The dewatering arrangement is formed in each wire unit 310,320 by two successive dewatering zones Z1*b*, Z2*b*, Z1*c*, Z2*c*. The dewatering zones Z1*b*, Z2*b*, Z1*c*, Z2*c* of each wire unit 310, 320 are entirely similar to the dewatering zone Z1*b*, Z2*b* of the second wire unit 310 shown in FIG. 1. The first dewatering zone Z1*b*, Z1*b* is formed by a non-pulsating formation shoe 200*b*, 200*c*, which is followed by a second pulsating dewatering zone Z2*b*, Z2*c* formed by fixed dewatering lists 210*b*, 210*c* and dewatering lists 230*b*, 230*c*, which can be loaded in a controlled manner.

Figure 6:
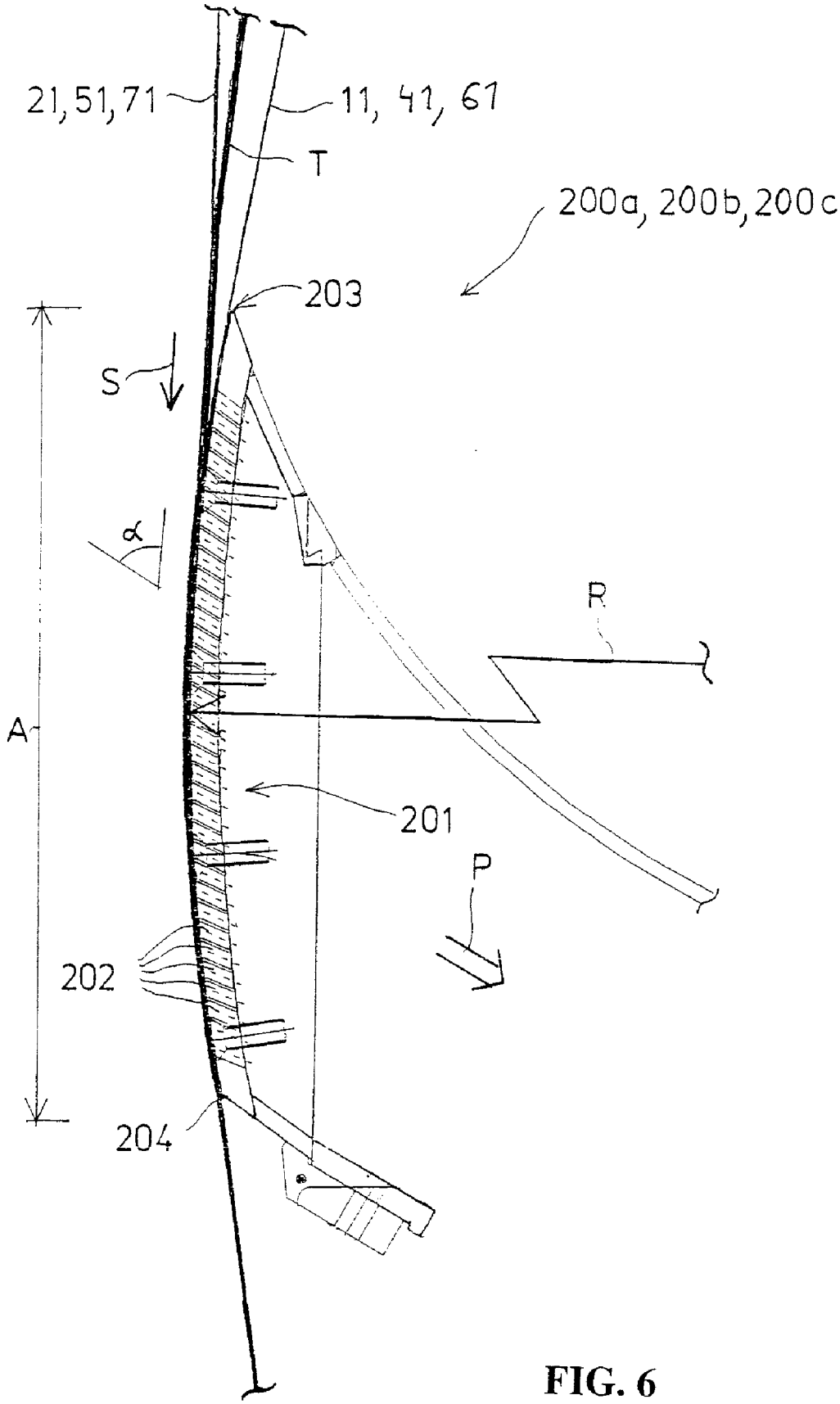
FIG. 6 shows an enlargement of a formation shoe used in the wire units of FIGS. 1-5.

FIG. 6 shows an enlargement of the fixed non-pulsating formation shoe 200*a*, 200*b*, 200*c* shown above in FIGS. 1-5. The formation shoe has a curved cap 201, which is placed against the inner surface of the formation wire 11, 31 and which has a leading edge 203 and a trailing edge 204. The cap 201 has an open surface formed by openings 202 extending through the cap 201. The openings 202 may be formed by holes, grooves, gaps or equivalent. Under the cap 201 an under-pressure is arranged, which is marked by the reference mark P and illustrated by an arrow and which is used to remove water from the pulp located in between the wires 11, 21, 31, 21, 41, 51 and 61, 71. The openings 202 are arranged in such a way in the cap 201 of the formation shoe that the open surface area of said cap 201 is large, most preferably 50-90%, and so that they do not due to their design and/or arrangement cause any pressure pulses in the web. Pressure pulses may be caused in the web, if the formation wire 11, 31, 41, 61 travelling on cap 201 is not evenly supported over the whole area of the cap 201. Pressure pulses will not be caused, if the openings are formed by holes or by gaps essentially in the lengthwise direction of the machine. When the openings 202 are formed by holes, they are preferably arranged obliquely in relation to the cap 201 in such a way against the travelling direction of the formation wire travelling over the cap that the water is better guided into them. The angle $\alpha$ between the central axis of holes 202 and a tangent to the cap's 201 outer surface is within a range of 30-75 degrees. Cap 201 is formed as a curved cap in such a way that the cap's radius of curvature R is within a range of 1-20 m. The radii of curvature R of the cap 201 of formation shoes located in the two-wire stretch are within a range of 1-5 m and the radii of curvature R of the cap 201 of formation shoes located in the single-wire section are within a range of 5-20 m. The overlap angle of formation wires 11, 31, 41, 61 in the area of cap 201 is within a range of 3-45 degrees, preferably 5-30 degrees. The cap length A in the machine direction is within a range of 200-1000 mm. Cap 201 may also be formed by several parts having different radii of curvature R.

It can be seen in FIG. 6 that the lip jet T of the headbox hits the formation wire 21, 41, which is outermost in relation to the cap 201 of formation shoe 200*a*, 200*b*, before the leading edge 203 of the cap 201 of the formation shoe, and that the formation wire 21,41 which is outer in relation to cap 201 comes into contact with the inner formation wire 11, 31 travelling on cap 201 only after a distance from the leading edge 203 of cap 201. Thus, the leading edge 203 of the formation shoe does not remove water from the pulp located in between the formation wires 31, 21 and 11, 41. Thus, there is time for removing the air transported along by the inner formation wire 11, 31 and the pulp jet T of headbox 100, 110 with the aid of under-pressure affecting through the openings 202 in the forward part of the formation shoe's cap 201 before the pulp located in between the formation wires 31, 21 or 11, 41 will meet the cap 201 of the formation shoe. The formation shoe removes water depending on the ratio between the tension of the outermost formation wire 21,41 and the radius of curvature R of the formation shoe's cap 201 (dewatering pressure=tension of wire 21, 41/radius of curvature of the cap 201 of the formation shoe 200*a*, 200*b*, that is P=T/R) and assisted by the under-pressure of the formation shoe. The level of under-pressure is preferably 1-30 kPa.

By changing the radius of curvature R of the cap 201 of the formation shoe 200*a*, 200*b*, 200*c* and/or by changing the under-pressure P existing in the shoe and/or the shoe length A it is possible to control the quantity and distribution of the water removed by the formation shoe from the web.

Thus, the first partial web W1 can be formed on a single-wire former or on a two-wire former. On a fourdrinier wire former, water is removed from the first partial web W1 only through the surface located against the fourdrinier wire 11 of the first partial web W1. Hereby fines in the first partial web W1 will discharge mainly from the surface of the first partial web W1 located against the fourdrinier wire 11, whereby fines will remain in the top surface opposite to the first partial web W1. When the first partial web W1 is joined to the second partial web W2 so that the surface of the first partial web W1 which is opposite to the fourdrinier wire 11 forms a joint surface for the first partial web W1, the fines located therein will promote the bringing about of a good joint between the first partial web W1 and the second partial web W2.

In the embodiments shown in FIGS. 1-3, the formation shoe 200*b* of the first dewatering zone Z1*b* of the second wire unit 310 is located at the beginning of the two-wire stretch inside the first wire link, but the formation shoe 200*b* could also be located at the beginning of the two-wire stretch inside the second wire link 51. Hereby the dewatering lists 210*b* of the pulsating dewatering zone Z2*b* are also placed inside the second wire link 51 and the dewatering lists 230*b*, which can be loaded in a controlled manner, are correspondingly located inside the first wire link 41 or vice versa.

In the embodiments shown in the figures only one formation shoe is shown at the beginning of the two-wire stretch, but there could also be more formation shoes. At the beginning of the two-wire stretch there can be, for example, two formation shoes mounted on opposite sides of the two-wire stretch. Hereby a meandering path is formed on the wires, which may cause runnability problems. On the same side of the two-wire stretch there may also be several successive formation shoes, if, for example, different under-pressure levels are desired in the formation shoes.

The headboxes 100, 110, 120 shown in the figures may be single-layer headboxes or multi-layer headboxes.

The consistency of the pulp suspension supplied by the headboxes 100, 110, 120 is within a range of 0.5-1.5%. A lower consistency generally allows a better formation and better strength properties, but the dewatering capacity in the early part of the formation section usually restricts a reduction of the consistency. With the solution according to the invention it is possible to use a lower consistency in the headbox owing to the higher dewatering capacity of the formation section.

Approximately 20-50% of the quantity of water contained in the pulp suspension supplied by the second headbox 110 can be removed by the first non-pulsating dewatering zone Z1*b* of the second wire unit 310, and approximately 40-70% of the water quantity contained in the pulp suspension supplied by the second headbox 110 can be removed by the second pulsating dewatering zone Z2*b*. At the joint N1 of the partial webs, the dry-matter content is usually about 5-8%.

In the embodiments shown in the figures the second dewatering zone Z2*b* of the second wire unit 310 is formed by fixed dewatering lists 210*b* and by dewatering lists 230*b*, which can be loaded in a controlled manner. The second dewatering zone Z2*b* may also be formed only by fixed dewatering lists 210*b*. The fixed dewatering lists 210*b* may form a direct passage for the wires travelling over them. With the under-pressure existing in the gaps 220*b* between the fixed dewatering lists 210*b* the passage of wires is somewhat deviated in said gaps 220*b*, whereby pulsating dewatering is brought about in the web located between the formation wires. The fixed dewatering lists 210*b* may also be located in such a way that they form a curved passage for the wires travelling over them. Hereby the dewatering lists 210*b* are at a small angle of about 0.5-2 degrees in relation to one another. By such an arrangement a boosted pulsating dewatering is brought about in the web located between the formation wires travelling over the dewatering lists. In both cases, the pulsating effect is boosted even more by using both fixed dewatering lists 210*b* and dewatering lists 230*b*, which can be loaded in a controlled manner.

In the embodiments shown in FIGS. 1-3 there are two wire units 300, 310, but the second wire unit 310 could when required be followed by several wire units of a corresponding kind. On each wire unit 310 following after the first wire unit 300 a new partial web is always formed, which is joined atop the web formed of the preceding partial webs.

In the embodiments shown in FIGS. 4 and 5 there are three wire units 300, 310, 320, but there could be more such when required. On each wire unit 310, 320 following after the first wire unit 300 a new partial web is always formed, which is joined atop the web formed of the preceding partial webs.

In the embodiments shown in FIGS. 1-4, it is possible in the first wire unit 300, that is, the fourdrinier wire unit, also to use other dewatering equipment, especially pulsating dewatering equipment after the non-pulsating formation shoe 200*a*.

Only some advantageous embodiments of the invention have been presented in the foregoing, and it is obvious to a professional in the art that numerous modifications can be made to them within the scope of the appended claims.

The invention claimed is:

1. A method of forming a multi-layer web in a formation section, comprising the steps of:

forming a first partial web on a first wire of a first wire unit with a first pulp suspension jet supplied by a first headbox at a forward end of the first wire unit;

forming a second partial web in a second wire unit from a second pulp suspension jet supplied by a second headbox, wherein the second pulp suspension jet is supplied to a jaw defined by a second wire of the second wire unit, and a third wire of the second wire unit, the second wire of the second wire unit and the third wire of the second wire unit forming a two-wire stretch which begins with the jaw, and wherein a forward end of the two-wire stretch is defined where the second wire of the second wire unit, and the third wire of the second wire unit meet;

performing non-pulsating dewatering of the second partial web in a first dewatering zone of the two-wire stretch of the second wire unit by moving the second wire of the second wire unit, and the third wire of the second wire unit, in the two-wire stretch over a curved cap of at least one fixed first formation shoe having a leading edge and located at the forward end of the two-wire stretch such that the cap engages one side of the two-wire stretch, and drawing water in an area following after the leading edge of the at least one fixed first formation shoe with under-pressure through holes or gaps which extend through the cap wherein said holes or gaps are essentially lengthwise in a machine direction and wherein the leading edge of the at least one first fixed formation shoe does not remove water from the second partial web in the first dewatering zone;

after the non-pulsating dewatering, performing pulsating dewatering in a second dewatering zone of the two-wire stretch of the second wire unit with fixed dewatering lists placed against a side of the two-wire stretch, the lists extending in the cross machine direction and forming cross machine direction gaps therebetween, and applying under-pressure through said gaps to the two-wire stretch; and bringing one of the second wire of the second wire unit or the third wire of the second wire unit, having the second partial web thereon, into engagement with the first wire of the first forming unit having the first partial web thereon to join the first partial web to the second partial web at a joint.

2. The method of claim 1 wherein the pulsating dewatering in the second dewatering zone of the two-wire stretch of the second wire unit is effected with loadable dewatering lists loaded in a controlled manner on a side of the two-wire stretch opposite the fixed dewatering lists, the loadable dewatering lists being positioned opposite the gaps between the fixed dewatering lists.

3. The method of claim 1 wherein in the step of forming a first partial web on the first wire of the first wire unit with the first pulp suspension jet, the first partial web is formed on a fourdrinier wire of a fourdrinier wire unit, the fourdrinier wire forming a loop, and the loop defining an interior.

4. The method of claim 3, wherein the first pulp suspension jet applies a fiber pulp to the fourdrinier wire, and further comprising the step of dewatering the fiber pulp on the fourdrinier wire in a first fourdrinier dewatering zone and in a second, successive fourdrinier dewatering zone.

5. The method of claim 4, wherein the step of dewatering in the first fourdrinier dewatering zone is accomplished as non-pulsating dewatering with a fixed fourdrinier formation shoe having a leading edge, and a curved cap, which fixed fourdrinier formation shoe is located interior to the loop at an impact point formed by the first pulp suspension jet with the fourdrinier wire, and wherein the non-pulsating dewatering takes place by moving the fourdrinier wire over the curved cap which is placed against an inner surface of the fourdrinier wire, and wherein the fiber pulp is non-pulsatingly dewatered in the first dewatering zone by drawing water from the fiber pulp through openings in the cap which extend through the cap, and effecting the dewatering of the fiber pulp with an under-pressure acting through the openings of the cap in an area following after the leading edge.

6. The method of claim 5, wherein the step of dewatering in the second fourdrinier dewatering zone comprises performing pulsating dewatering with a suction box having a list cap placed against an inner surface of the fourdrinier wire loop interior, the suction box being located at an output end of the fourdrinier wire unit and further applying under-pressure with the suction box through openings in the list cap, whereby the fiber pulp traveling on the fourdrinier wire is subjected to pulsating dewatering in the area of the suction box.

7. The method of claim 1 wherein in the step of forming the first partial web on the first wire with the first pulp suspension jet comprises supplying the first pulp suspension jet into a jaw at a forward end of the first wire unit, the jaw being defined by the first wire and a superpositioned wire forming a first two-wire stretch, the first two wire stretch defining a beginning where the first wire and the superpositioned wire first meet.

8. The method of claim 7 wherein dewatering of the first partial web is accomplished in a first dewatering zone and a second successive dewatering zone in the first two-wire stretch of the first wire unit.

9. The method of claim 8, wherein dewatering is accomplished as non-pulsating dewatering in the first dewatering zone of the first wire unit which is at the beginning of the first two-wire stretch of the first wire unit, said non-pulsating dewatering being accomplished with a further fixed formation shoe which has a leading edge and a curved cap, the further fixed formation shoe being placed against an inner surface of the first wire, wherein the further fixed formation shoe cap has portions defining openings which extend through the cap wherein said openings are essentially lengthwise in the machine direction; and applying under-pressure to the cap openings whereby fiber pulp from the first pulp suspension jet traveling in between the first wire and the superpositioned wire is subjected to a non-pulsating dewatering area following after the leading edge of the further fixed formation shoe and wherein the leading edge of the further fixed formation shoe does not remove water from the first partial web in the first dewatering zone.

10. The method of claim 9, wherein dewatering is accomplished as pulsating dewatering in the second dewatering zone of the first wire unit of the first two-wire stretch of the first wire unit, said pulsating dewatering being accomplished with fixed dewatering lists placed against one side of the first two-wire stretch in a cross machine direction; and further comprising the step of applying under-pressure through cross machine direction gaps defined between the lists and subjecting the fiber pulp between the first wire and the superpositioned wire to pulsating dewatering.

11. The method of claim 10, further comprising the step of further accomplishing dewatering in the second dewatering zone of the first wire unit by loading in a controlled manner movable lists located on an opposite side of the second two-wire stretch in relation to the fixed dewatering lists at the gaps between the fixed dewatering lists.

12. The method of claim 1 wherein the at least one fixed first formation shoe cap defines a total surface area and wherein water is drawn though 50-90% of the total surface area of the cap.

13. The method of claim 1 wherein the at least one fixed first formation shoe draws water though the openings in the cap along an angle of 30-75 degrees between central axes of the openings and a tangent to the cap's outer surface obliquely against a traveling direction defined by the first formation wire.

14. The method of claim 1 wherein the two-wire stretch moves about a radius of curvature of 1-5 m as the two-wire stretch moves over the at least one fixed first formation shoe.

15. The method of claim 1 wherein non-pulsating dewatering is performed by the at least one fixed first formation shoe in such a way that the overlap angle of the formation wire traveling over the first formation shoe is 3 degrees to 45 degrees in an area defined by the cap.

16. A multi-layer web formation section comprising:

a first wire unit for forming a first partial web, the first wire unit having a first wire, a forward end, and an output end;

a first headbox, arranged to supply a first pulp suspension jet to the forward end of the first wire unit;

a second wire unit succeeding the first wire unit, the second wire unit having a two-wire stretch defined by a second wire and a third wire, the second wire and the third wire forming a closing jaw at a forward end where the second wire and the third wire come together, and forming an output end where the second wire and the third wire are separated from one another, the two-wire stretch defining a first side and a second side;

a second headbox located at the forward end of the two-wire stretch of the second wire unit and which is arranged to supply a second pulp suspension jet into the closing jaw;

a joint formed in between the second wire unit and the first wire so that a second partial web formed in the second wire unit will join to a first partial web carried on the first wire;

a first dewatering zone defined by at least one fixed first formation shoe having a leading edge and a curved cap positioned on one side and at the forward end of the two-wire stretch, the at least one fixed first formation shoe having the curved cap placed against the first side or the second side of the two-wire stretch, the cap having portions defining openings which extend through the cap, which openings are connected to a source of under-pressure, wherein the openings are formed by holes or by gaps extending essentially in the lengthwise direction of the machine, the at least one fixed first formation shoe arranged such that fiber pulp traveling in-between the second and third wires of the two-wire stretch is subjected to non-pulsating dewatering in an area following after the leading edge of the at least one fixed first formation shoe and wherein the leading edge of the at least one fixed first formation shoe is arranged not to remove water from the fiber pulp traveling in-between the second and third wires of the two-wire stretch; and a second dewatering zone positioned after the first dewatering zone along the two-wire stretch of the second wire unit and defined by fixed dewatering cross machine direction extending lists placed against the first side or the second side of the two-wire stretch, the lists defining gaps between the lists, the gaps connected to a source of under-pressure such that a fiber pulp traveling in between the second forming wire and the third forming wire is subjected to pulsating dewatering by the fixed dewatering lists and by under-pressure.

17. The multi-layer web formation section of claim 16, wherein the second dewatering zone of the second wire unit also comprises loadable dewatering lists of the type which are structured so as to be loaded in a controlled manner, and which are located on the first side or the second side of the two-wire stretch which is opposite in relation to the fixed dewatering lists, and positioned at the gaps between the fixed dewatering lists.

18. The multi-layer web formation section of claim 16, wherein the first wire unit is a fourdrinier wire unit, and the first headbox is arranged to apply the pulp suspension jet on to the first wire which is a fourdrinier wire, the fourdrinier wire defining an inner surface.

19. The multi-layer web formation section of claim 18 wherein the fourdrinier wire unit has two successive dewatering zones.

20. The multi-layer web formation section of claim 19, wherein the fourdrinier wire unit two successive dewatering zones comprise a first dewatering zone and a second dewatering zone, and wherein the first dewatering zone is defined by a fixed fourdrinier formation shoe which is located at the beginning of the fourdrinier wire unit at a point where the pulp suspension jet is arranged to impact the fourdrinier wire, the fixed fourdrinier formation shoe having a curved cap placed against the inner surface of the fourdrinier wire and having portions defining openings extending through the cap wherein said openings are holes or gaps which extend essentially lengthwise in the machine direction, the openings connected to a source of under-pressure, so that the fixed fourdrinier formation shoe is arranged to subject a fiber pulp traveling on the fourdrinier wire to non-pulsating dewatering in an area following after a leading edge of the fixed fourdrinier formation shoe and wherein the leading edge of the fixed fourdrinier formation shoe is arranged not to remove water from the fiber pulp traveling on the fourdrinier wire.

21. The multi-layer web formation section of claim 20, wherein the second dewatering zone of the fourdrinier wire unit is formed by a suction box which is located at an output end of the fourdrinier wire unit, and wherein the suction box has a list cap which is positioned against the inner surface of the fourdrinier wire, portions of the list cap defining openings which are connected to a source of under-pressure so that a fiber pulp traveling on the fourdrinier wire is subjected to pulsating dewatering by the suction box.

22. The multi-layer web formation section of claim 20 wherein the fixed fourdrinier formation shoe has a radius of curvature of 5-20 m.

23. The multi-layer web formation section of claim 16, wherein the first wire unit is a wire unit equipped with a superpositioned wire forming a first two-wire stretch with the first wire and forming a first jaw at the forward end of the first wire unit, the first two-wire stretch defining a beginning where the first wire and the superpositioned wire first meet, and wherein the first headbox is arranged to supply the first pulp suspension jet into the first jaw.

24. The multi-layer web formation section of claim 23, wherein there is a first dewatering zone, and a second dewatering zone after the first dewatering zone in the first two-wire stretch of the first wire unit.

25. The multi-layer web formation section of claim 24, wherein the first dewatering zone of the first wire unit is formed by a further fixed formation shoe having a leading edge and located at the beginning of the first two-wire stretch of the first wire unit, and wherein the further fixed formation shoe has a curved cap placed against an inner surface defined by the first wire, the further fixed formation shoe having portions defining openings extending through the cap, wherein said openings are holes or gaps which extend essentially lengthwise in a machine direction, the openings connected to a source of under-pressure, so that the further fixed formation shoe is arranged to subject fiber pulp traveling between the first forming wire and the superpositioned forming wire to non-pulsating dewatering in an area following after the leading edge of the further fixed formation shoe.

26. The multi-layer web formation section of claim 25, wherein the second dewatering zone of the two-wire stretch of the first wire unit is formed by first fixed dewatering cross machine direction extending lists which are placed against one side of the first two-wire stretch, the lists defining cross machine direction extending gaps between the lists, the gaps connected to a source of under-pressure so that the fiber pulp traveling in between the first forming wire and the superpositioned wire is subjected to pulsating dewatering by the first fixed dewatering lists and by under-pressure.

27. The multi-layer web formation section of claim 26, wherein the second dewatering zone of the first wire unit further comprises first loadable dewatering lists, of the type which are mounted so as to be loaded in a controlled manner, and which are located on the opposite side of the two-wire stretch in relation to the first fixed dewatering lists at the gaps between the first fixed dewatering lists.

28. The multi-layer web formation section of claim 25, wherein the openings which extend through the further fixed formation shoe cap are 50-90% of a total surface area defined by the cap.

29. The multi-layer web formation section of claim 16, wherein the openings which extend through the cap are orientated obliquely against a traveling direction defined by the first formation wire, so that the holes form an angle of 30-75 degrees between central axes of the holes and a tangent to an outer surface defined by the cap.

30. The multi-layer web formation section of claim 16, wherein the cap has a radius of curvature of 1-5 m.

31. The multi-layer web formation section of claim 16 wherein the first formation wire has an overlap angle of 3-45 degrees with respect to an area defined by the cap of the first fixed formation shoe.

32. A method of forming a multi-layer web in a formation section, comprising the steps of:

forming a first partial web on a first wire of a first wire unit with a first pulp suspension jet supplied by a first headbox at a forward end of the first wire unit;

forming a second partial web in a second wire unit from a second pulp suspension jet supplied by a second headbox, wherein the second pulp suspension jet is supplied to a jaw defined by a second wire of the second wire unit, and a third wire of the second wire unit, the second wire of the second wire unit, and the third wire of the second wire unit forming a two-wire stretch which begins with the jaw, and defining a forward end of the two wire stretch where the second wire of the second wire unit, and the third wire of the second wire unit meet;

non-pulsatingly dewatering the second partial web in a first dewatering zone of the two-wire stretch of the second wire unit by moving the second wire of the second wire unit, and the third wire of the second wire unit, in the two-wire stretch, over a curved cap of a least one fixed first formation shoe having a leading edge and located at the forward end of the two-wire stretch such that the cap engages one side of the two-wire stretch, and drawing water with under-pressure through holes or gaps which extend through the cap and are essentially lengthwise in a machine direction and wherein the leading edge of the at least one fixed first formation shoe does not remove water from the second partial web in the first dewatering zone;

after the non-pulsating dewatering, pulsatingly dewatering in a second dewatering zone of the two-wire stretch of the second wire unit with fixed dewatering lists placed against a side of the two-wire stretch, the lists extending in the cross machine direction and forming cross machine direction gaps therebetween, and through said gaps applying under-pressure to the two-wire stretch;

bringing one of the second wire of the second wire unit, or the third wire of the second wire unit, having the second partial web thereon into engagement with the first wire of the first forming unit having the first partial web thereon to join the first partial web to the second partial web at a joint;

wherein pulsating dewatering in the second dewatering zone of the two-wire stretch of the second wire unit is effected with loadable dewatering lists loaded in a controlled manner on a side of the two-wire stretch opposite the fixed dewatering list, the loadable dewatering lists positioned opposite the gaps between the fixed dewatering lists;

wherein in the step of forming the first partial web on the first wire with the pulp suspension jet is by supplying the suspension jet into a jaw at a forward end of the first wire unit, the jaw formed by the first wire and a superpositioned wire forming a first two-wire stretch, the first two wire stretch defining a beginning where the first wire and the superpositioned wire first meet;

wherein dewatering of the first partial web formed on of the first wire unit is accomplished in a first dewatering zone of the first wire unit as non-pulsating dewatering at the beginning of the first two-wire stretch of the first wire unit with a further fixed formation shoe which has a leading edge and a curved cap, the further fixed formation shoe being placed against an inner surface of the first wire; and applying under-pressure through portions of the further fixed formation shoe cap forming holes or gaps which extend through the cap and are essentially lengthwise in the machine direction, which holes or gaps extend through the further fixed formation shoe cap whereby fiber pulp from the first pulp suspension jet traveling in between the first wire and the superpositioned wire, is subjected to a non-pulsating dewatering area following after the leading edge of the further fixed formation shoe and wherein the leading edge of the further fixed formation shoe does not remove water from the first partial web in the first dewatering zone of the first wire unit;

wherein pulsating dewatering of the first partial web formed on the first wire unit is accomplished in a second successive dewatering zone in the first two-wire stretch of the first wire unit with fixed dewatering lists placed against one side of the first two-wire stretch in a cross machine direction, and applying under-pressure through cross machine direction gaps defined between the lists and subjecting the fiber pulp between the first wire and the superpositioned wire formation wire to pulsating dewatering; and further accomplishing dewatering by loading in a controlled manner movable lists located on an opposite side of the first two-wire stretch in relation to the fixed dewatering lists at the gaps between the fixed dewatering lists.

* * * * *

UNITED STATES PATENT AND TRADEMARK OFFICE

CERTIFICATE OF CORRECTION

PATENT NO. : 7,608,165 B2
APPLICATION NO. : 10/597940
DATED : October 27, 2009
INVENTOR(S) : Räisänen et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 538 days.

Signed and Sealed this

Twelfth Day of October, 2010

David J. Kappos

David J. Kappos
*Director of the United States Patent and Trademark Office*